United States Patent [19]

Praba

[11] Patent Number: 4,635,006

[45] Date of Patent: Jan. 6, 1987

[54] ADJUSTABLE WAVEGUIDE BRANCH DIRECTIONAL COUPLER

[75] Inventor: Krishna Praba, Cherry Hill, N.J.

[73] Assignee: RCA Corporation, Princeton, N.J.

[21] Appl. No.: 683,237

[22] Filed: Dec. 18, 1984

[51] Int. Cl.[4] ..... H01P 5/04; H01P 5/18

[52] U.S. Cl. ..... 333/111; 333/113

[58] Field of Search ..... 333/111, 113, 114, 110, 333/109, 24 R, 248; 324/95

[56] References Cited

U.S. PATENT DOCUMENTS

| | | | |
|---|---|---|---|
| 2,106,769 | 2/1938 | Southworth | 333/35 |
| 2,558,385 | 6/1951 | Purcell | 333/113 |
| 3,044,026 | 7/1962 | Patterson | 333/113 |
| 3,175,171 | 3/1965 | Reindel | 333/111 |
| 3,195,075 | 7/1965 | Veltrop | 333/111 |
| 3,254,309 | 5/1966 | Miller | 330/287 |
| 3,758,879 | 9/1973 | Beguin et al. | 333/111 |
| 3,928,825 | 12/1975 | Kaffenberger | 333/34 |

*Primary Examiner*—Eugene R. LaRoche
*Assistant Examiner*—Benny T. Lee
*Attorney, Agent, or Firm*—Joseph S. Tripoli; Robert L. Troike; William H. Meise

[57] ABSTRACT

A waveguide branch directional coupler having a pair of parallel main waveguides defining four ports and a plurality of branch waveguides interconnecting the two main waveguides to establish a predetermined amount of coupling between the ports has the coupling between ports adjusted by mechanically changing the height dimension of the main waveguides.

3 Claims, 15 Drawing Figures

FOUR-BRANCH WAVEGUIDE COUPLER

| COUPLING | | BRANCH WAVEGUIDE HEIGHT NORMALIZED TO THROUGH WAVEGUIDE HEIGHT | | RATIO OF INNER BRANCH HEIGHT TO OUTER BRANCH HEIGHT C/A |
|---|---|---|---|---|
| dB | RATIO x | OUTER A | INNER C | |
| 2 | .794328 | .276254 | .626507 | 2.267869 |
| 3 | .707946 | .235002 | .541972 | 2.306242 |
| 4 | .630957 | .202984 | .473479 | 2.332598 |
| 5 | .562341 | .176918 | .416046 | 2.351631 |
| 6 | .501187 | .155113 | .366962 | 2.365774 |
| 7 | .446684 | .136552 | .324512 | 2.376478 |
| 8 | .398107 | .120565 | .287508 | 2.384679 |
| 9 | .354814 | .106680 | .255074 | 2.391019 |
| 10 | .316228 | .094548 | .226532 | 2.395952 |
| 11 | .281838 | .083899 | .201340 | 2.399807 |

*Fig. 4a*

SIX-BRANCH WAVEGUIDE COUPLER

| COUPLING | | BRANCH WAVEGUIDE HEIGHT NORMALIZED TO THROUGH WAVEGUIDE HEIGHT | | RATIO OF HEIGHT OF ONE OF FOUR INNER BRANCHES TO HEIGHT OF ONE OF TWO OUTER BRANCHES C/A |
|---|---|---|---|---|
| dB | RATIO x | TWO OUTER BRANCHES A | FOUR INNER BRANCHES C | |
| 2 | .794328 | .172095 | .370274 | 2.151561 |
| 3 | .707946 | .146607 | .318330 | 2.171317 |
| 4 | .630957 | .126760 | .276926 | 2.184646 |
| 5 | .562341 | .110565 | .242596 | 2.194148 |
| 6 | .501187 | .096992 | .213493 | 2.201148 |
| 7 | .446684 | .085422 | .188476 | 2.206418 |
| 8 | .398107 | .075446 | .166768 | 2.210424 |
| 9 | .354814 | .066774 | .147807 | 2.213528 |
| 10 | .316228 | .059192 | .131165 | 2.215920 |
| 11 | .281838 | .052533 | .116507 | 2.217798 |

*Fig. 4b*

ADJUSTABLE WAVEGUIDE BRANCH DIRECTIONAL COUPLER

This invention relates to waveguide directional couplers of the branch type having mechanical adjustment of the amount of coupling.

Directional couplers and splitters find wide use in transmission-line applications. At frequencies in the range of 1 MHz to 200 MHz, coaxial directional couplers are used for combining the power from power amplifiers of broadcast transmitters while maintaining impedance match, and directional couplers having coupling values other than 3 db (as, for example, 10 or 20 db) have long been used in cable television (CATV) systems for coupling television signal samples from a main line to a subscriber. The losses of coaxial cable increase rapidly with increasing frequency, and consequently waveguide transmission lines are often used at frequencies in and above the UHF frequency range (above 300 MHz). Waveguide is used almost exclusively at X-band (8.2–12.4 GHz) and at higher frequencies. Directional couplers are used in conjunction with waveguide systems for sampling and for combining signals from low-level signal sources to produce high-power signals.

Branch-type directional couplers are formed with two lengths of transmission-line, each defining an input and an output port. Branch transmission lines couple the two main transmission lines together at various points selected to provide the appropriate level of coupling. Any one of the four ports may be selected as an input, and the other port of the same transmission line is termed a through-port, while that output port of the other main waveguide to which power is coupled is called a cross-port. The second port of the other main waveguide is the isolated port. When used for power combining, quadrature phase signal from two sources are applied to the "through-port" and to the "cross-port", and the combined signal is taken from the "input" port. In the case of waveguide directional couplers, two parallel waveguides are interconnected at nominal quarter-wave length increments with branch waveguides having smaller height dimensions than the main waveguides. When signal power is applied to an input port of one of the two main waveguides, a portion branches off at each successive branch waveguide, depending upon the amount of remaining power in the main waveguide and the relative size of the branch waveguide relative to the main waveguide. These signal powers emerge from the branch waveguides into the second waveguide, adding in phase to reinforce and produce output signal in the direction of the cross-port, and adding out-of-phase so as to cancel at the other or isolated port of the second waveguide. Branch type waveguide directional couplers are advantageous not only because of their high power-handling capability and low loss, but also because the dimensions of the branch waveguides required to achieve a predetermined coupling, impedance match (VSWR) and isolation can be calculated.

It is well known that dimensions of components and transmission lines at frequencies in X-band and above tend to become small because of the relatively small wavelengths at those frequencies, and therefore high tolerances are required to fabricate parts having dimensions which must be accurately kept to fractions of a wavelength. At X-band, the free-space wavelength is about 1.2 inches, and one quarter-wavelength is about 0.3 inches. Normal manufacturing tolerances when used to fabricate a waveguide branch directional coupler calculated to produce a particular predetermined amount of coupling may result in a coupling value other than that desired. This problem is ordinarily avoided by the use of extraordinary precision in the fabrication of the coupler. In the event that the coupling value of the coupler so fabricated deviates from the desired value, it has heretofore been necessary to design a new coupler having a coupling value selected away from the desired coupling value in such a fashion as to compensate for whatever errors in fabrication resulted in the coupling error. A new coupler is then fabricated based upon the new dimensions. This procedure is tedious, time-consuming and wasteful. It would be very advantageous to be able to adjust the coupling factor of a waveguide branch directional coupler without significantly affecting the impedance match or the isolation to the branch port.

SUMMARY OF THE INVENTION

An adjustable waveguide branch directional coupler includes first and second rectangular waveguide sections oriented parallel to each other. Each of the first and second waveguide sections has a pair of wide walls separated or spaced from each other. A plurality greater than one of branch waveguides extend from one of the wide walls of the first waveguide section to one of the wide walls of the second waveguide section in order to provide coupling between the first and second waveguides. Adjustment of the coupling is provided by mechanically changing the spacing between the wide walls of each of the pairs of wide walls.

DESCRIPTION OF THE DRAWING

FIGS. 1*a* and 1*c* illustrate details thereof;

FIG. 4*a* is a table listing the normalized branch heights of the 4-branch coupler of FIG. 2 for various amounts of coupling, and also listing the ratio of the branch heights, and FIG. 4*b* is a similar list for a 6-branch coupler;

DESCRIPTION OF THE INVENTION

Figure 1A:
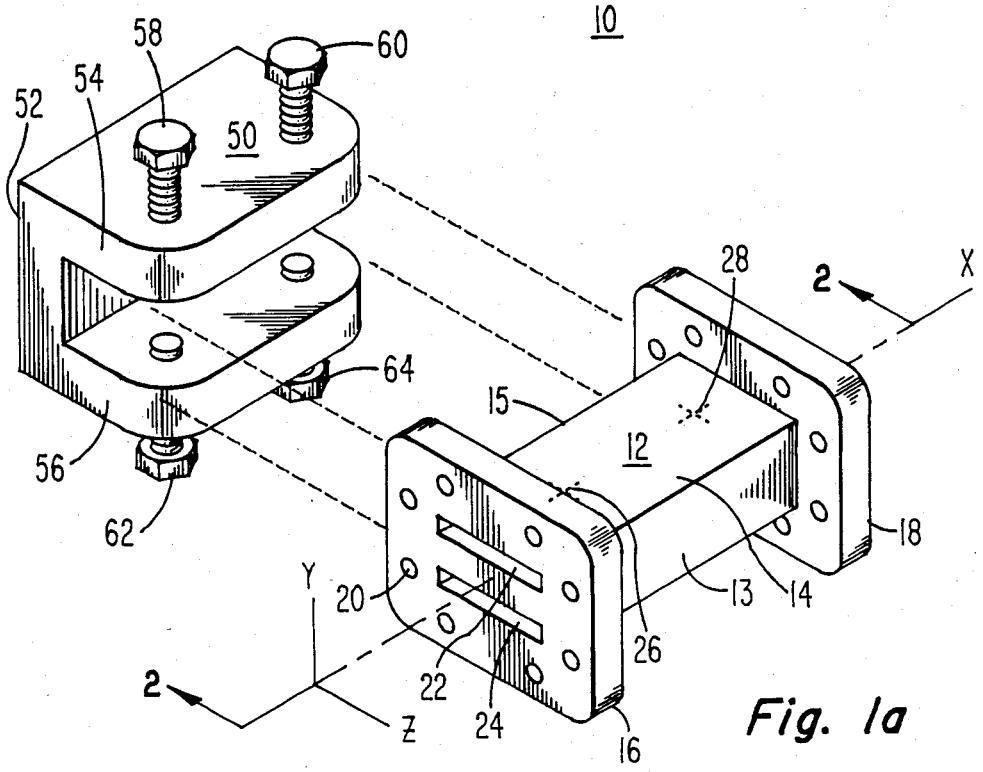
FIG. 1*a* illustrates in perspective view a waveguide branch directional coupler and a clamp for adjusting the coupling.

In FIG. 1, an adjustable waveguide directional branch coupler designated generally as 10 is illustrated in exploded view, and includes the branch coupler 12 and adjuster 50. Coupler 12 includes a side wall 13 and a top wall 14 which are integral with flanges 16 and 18. Flanges 16 and 18 include screw holes, one of which is designated 20. Flanges 16 and 18 each contain apertures which correspond to ports of the directional coupler. In FIG. 1, ports 22 and 24 can be seen which have the same dimensions as the through waveguide described hereinafter. In order to provide adjustment of the coupling, adjuster 50 includes a back wall 52 and upper and lower arms 54 and 56, respectively, which are dimensioned to fit between flanges 16 and 18 and over the major part of the coupler including wall 14. Upper arm 54 of adjuster 50 is perforated by threaded holes into which screws 58 and 60 are threaded, and coaxial therewith in lower arm 56 are corresponding apertures into which are threaded screws 62 and 64. The dimensions of adjuster 50 are such that screw 58 contacts wall 14 at point 26, and screw 60 contacts wall 14 at point 28, both points lying approximately on a center-line of coupler 12.

Figure 1B:
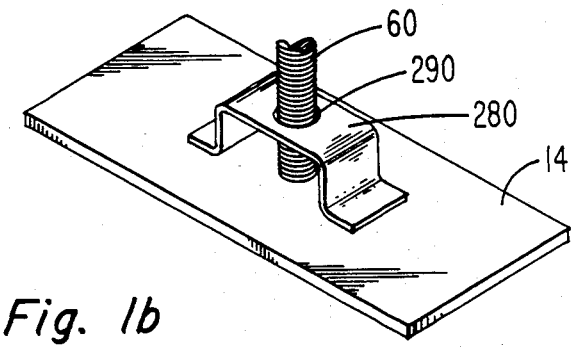
Figure 1C:
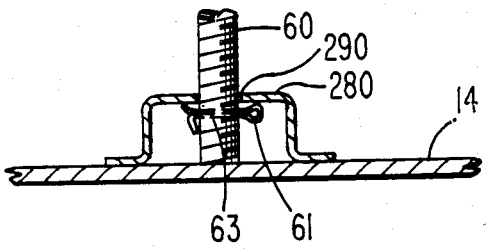

FIG. 1*b* illustrates in perspective view an arrangement for captivating screw 60 to upper wall 14 of coupler 12. In FIG. 1*b*, screw 60 passes through a clearance aperture 290 in a bracket 280 welded or otherwise fastened to the upper surface of upper wall 14 of coupler 12. As can be seen in the sectional view of FIG. 1*c*, a cotter-pin 61 placed in hole 63 drilled through screw 60 captivates screw 60 and prevents its withdrawal. Thus, turning screw 60 in the threaded hole in upper arm 54 of adjuster 50 causes a force to be imparted to wall 14.

Figure 2:
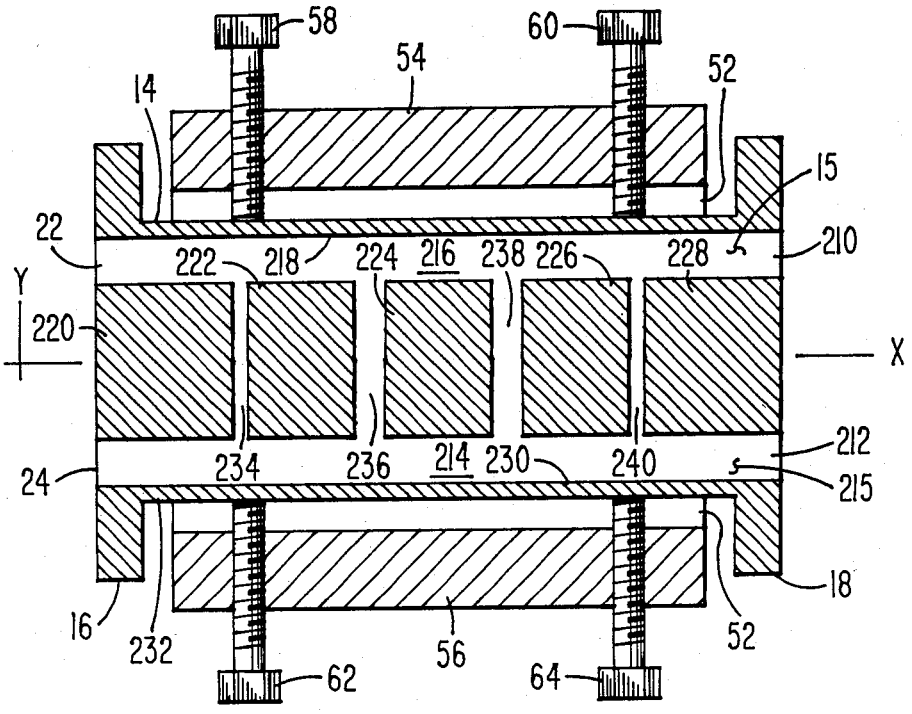
FIG. 2 is a cross-sectional view of the waveguide directional coupler of FIG. 1, together with its adjuster.

FIG. 2 is a cross-sectional view of coupler 12 and adjuster 50 taken in a direction 2—2. As can be seen in FIG. 2, port 22 communicates axially through coupler 12 to an output port 210 by a main waveguide portion 216, and port 24 communicates with port 212 by way of a main waveguide portion 214. An upper wide wall of waveguide 216 is defined by the inner surface 218 of wall 14. A narrow wall of waveguide section 216 is defined by that portion of rear wall 15 (FIG. 1*a*) between surface 218 and those portions of blocks 220–228 facing surface 218. The lower wide wall of waveguide portion 216 is defined by the conductive surfaces of blocks 220, 222, 224, 226, 228 which face surface 218. Similarly, a wide wall of waveguide portion 214 is defined by the inner surface 230 of lower wall 232 of the body of the coupler. The surfaces of blocks 220, 222, 224, 226, 228 facing surface 230 define the opposite wide wall of waveguide portion 214. A narrow wall of waveguide section 214 (parallel to the X-Y plane) is defined by a portion 215 of wall 15. It will be understood that the half-section of coupler 12 not visible in the section of FIG. 2 is symmetrical therewith.

The spacing between blocks 220 and 222 defines a branch waveguide 234 which communicates between waveguide portions 214 and 216 to provide coupling therebetween. Similarly, the spacing between blocks 222 and 224 defines a branch waveguide 236, and the spacing between blocks 224 and 226 and 228 defines branch waveguides 238 and 240, respectively, all of which branch waveguides provide communication between waveguide portions 214 and 216. The width (dimension in the z direction) of each branch waveguide equals the width of the main waveguide. For example, the main waveguides 214 and 216 may have cross-sectional dimension of 0.200×0.750 inches, and the branch waveguides will also have widths of 0.750 inches. Branch waveguides 234 and 240 are termed "outer" branch waveguides, while branch waveguides 236 and 238 are "inner" branches. The heights (dimension in the X direction) of the branch waveguides are not equal to the height (dimension in the Y direction) of the main waveguides.

Figure 3:
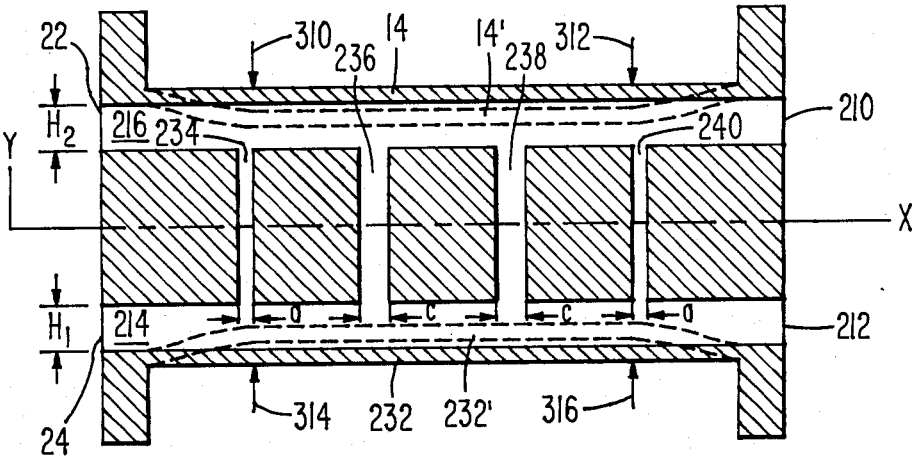
FIG. 3 is a simplified representation of the cross-sectional view of FIG. 2.

FIG. 3 illustrates in simplified form the arrangement of FIG. 2. The heights of waveguides 214 and 216 are designated H1 and H2 respectively. Heights H1 and H2 are equal. The heights of outer branches 234 and 240 are designated a, and the heights of inner branches 236 and 238 are designated c. Branch waveguides 234 to 240 are center-to-center separated from each other by one quarter wavelength, and have a length (dimension parallel to the Y-axis) of one quarter-wavelength. For a 4-branch coupler such as is illustrated in FIG. 3, the relative height of an inner branch relative to the height of a through waveguide such as 214 or 216 is given by the equation:

$$c = \sqrt{1 - \sqrt{1 - x^2}}$$

where the value x is the coupling value given by the equation:

$$\text{dB} = 20 \log_{10} x$$

or $$x = 10^{dB/20}$$

The height of the outer branches 234 and 240 relative to waveguides 214 and 216 is given by the equation:

$$a = \frac{c((\sqrt{2 - c^2}) - 1}{\sqrt{1 - c^2}}$$

As mentioned, the branch waveguides have the same width as the through waveguides.

FIG. 4*a* tabulates outer branch a and inner branch c heights of a 4-branch coupler. The inner and outer branch lengths are normalized to the through waveguide height and are shown for coupling values ranging from 2 to 11 dB, corresponding to ratios of x ranging from 0.79 to 0.28. For the coupling values shown, the ratio of the inner branch heights to the outer branch heights range from 2.26 to 2.39. These ratios are within plus or minus three percent for the wide range of coupling values of 2 to 11 dB. This result is surprising, and indicates that proportional changes in the heights of the inner and outer waveguides without changing the through waveguide height results in changes in coupling while maintaining all the desirable characterisics of the coupler such as impedance match and isolation. Viewed in another manner, it means that the amount of coupling can be changed without changing the branch waveguides by adjusting the height of the through waveguide. Naturally, adjustment of the height of the through waveguide over the entire length of the coupler will cause a discontinuity between the feed waveguide and the coupler through waveguides at the input and output ports. FIG. 3 illustrates as arrows 310, 312, 314, 316 the forces applied by tightening screws 58, 60, 62, 64 to upper wall 14 of the directional coupler and to lower wall 232. Turning the screws in the opposite direction reverses the direction of the force. As can be seen, these forces are applied at points along the wall which tend to deflect the walls to positions 14' and 232'. Since the end flanges hold the walls in relatively fixed position near the output ports, no change in height occurs at the ports and therefore no impedance discontinuity occurs at these points. The walls taper inward from the ports, reducing (or increasing) the effective height H1 of through or main waveguide 214 and H2 of through or main waveguide 216. It will be noted that at the position of the branch waveguides, heights H1 and H2 are reduced when walls 14 and 232 are deflected to positions 14' and 232'. As a result, the amount of coupling can be expected to change without significant effect on impedance match at the ports or on isolation to the isolated port. Naturally, for the structure as illustrated only relatively small deflections of the walls maybe expected without permanent deformation.

FIG. 4*b* is a tabulation of the branch waveguide heights for a 6-branch coupler (not shown), for coupling factors ranging from two to 11 dB, and including the ratio of the heights of inner to outer branches. As in the case of the four-branch coupler, these ratios change only about ±1.5% for a wide range of coupling values. A six-branch coupler has four equal-height inner branches and two equal-height outer branches.

Figure 5:
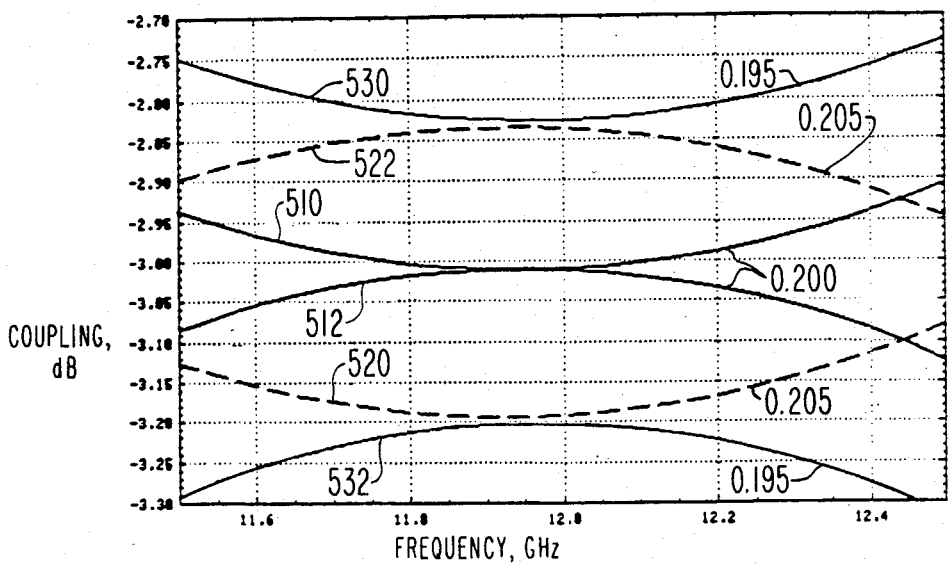
FIG. 5 is a plot of calculated coupling versus frequency for various main waveguide heights selected by adjustment according to the invention.

FIG. 5 is a plot of the computed coupling value of a 4-branch waveguide coupler designed for a coupling value of 3 dB at a center frequency of 12 GHz. That is to say, that if signal power at 12 GHz is applied to input port 22, equal powers will be coupled to output ports 210 and 212, and no power will be coupled to output port 24. Since the arrangement as illustrated in FIG. 3 is symmetrical, any port may be taken as the input port with the same result. In FIG. 5, curve 512 illustrates the relative power coupled from input port 22 to through output port 210 (to that output port communicating directly with the input port by means of a through waveguide), and curve 510 illustrates the power coupled to cross-port 212 from input port 22 (that is to say, the power coupled to an output port by way of branch waveguides). It can be seen that in the center-frequency region of approximately 12 GHz, the coupling to each of output ports 210 and 212 is equal and has a value of about 3.01 dB. It should be noted that the exact decimal value for half-power is 3.01 dB rather than 3.00 dB, the commonly mentioned number. The attenuation from input port 22 to output port 210 increases at frequencies away from the center frequencies, as indicated by curve 512. This is because the coupling through the branch waveguides is no longer at it's ideal value, and more power is shunted away from through waveguide 216 to output port 212. Similarly, curve 510 shows that since the amount of power remaining in through waveguide 216 in the path between input port 22 and output port 210 decreases, more power is coupled to output port 212, and therefore the power coupled to cross-port 212 increases at frequencies away from the 12.0 GHz center frequency. Curves 520 and 522 illustrate what happens when the height of the through waveguide is increased by 0.005 inches from 0.200 to 0.205 inches. As can be seen, the center-frequency attenuation or loss between input port 22 and cross-port 212 increases to almost 3.2 dB, as illustrated by curve 520, and the power coupled to through port 210 increases to a value of −2.83 dB, as illustrated by curve 522. Curves 530 and 532 illustrate the coupling for a change in through waveguide height by 0.005 from 2.000 to 0.195 inches. As can be seen by curve 530, the coupling between input port 22 and cross-port 212 increases to a center-frequency of about 2.82 dB, and the coupling to through port 210 correspondingly decreases to about 3.21 dB. From consideration of the curves illustrated in FIG. 5, it is clear that for the particular coupler illustrated, a change of 0.005 inches in the height of main waveguides 214 and 216 results in a change in coupling of about 0.17 to 0.2 dB. While the isolation to isolated port 24 may change slightly, it still exceeds 40 dB across a 500 MHz band. The VSWR change ideally is from 1.000 to 1.003, which is insignificant. Thus, the illustrated arrangement provides an effective means for changing the coupling of a waveguide branch coupler.

Figure 6:
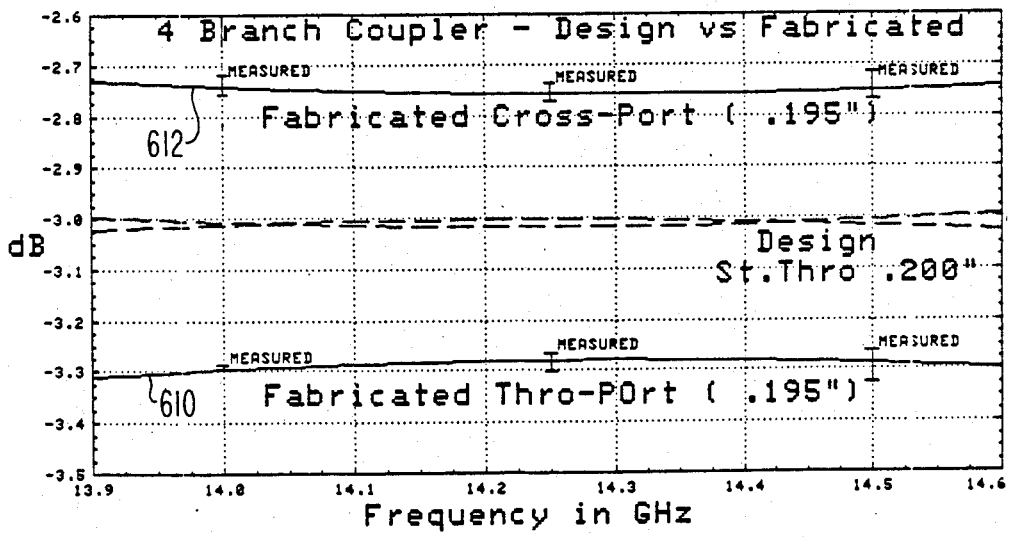
FIG. 6 is a plot comparing calculated and measured coupling.

FIG. 6 illustrates over a range of 13.9 to 14.6 GHz the design through-port and cross-port signal levels for main waveguide heights of 0.200 inches for a branch coupler designed for 3.00 dB coupling, and also illustrates the calculated through-port coupling 610 and the calculated cross-port coupling 612 for the case in which the main waveguide heights are changed to 0.195 inch. The measured through-port and cross-port coupling at 14.0, 14.25 and 14.5 GHz are illustrated, and these measurements correspond with the calculated values, thereby indicating that the coupling changes in the fashion as discussed in conjunction with FIG. 5.

Figure 12:
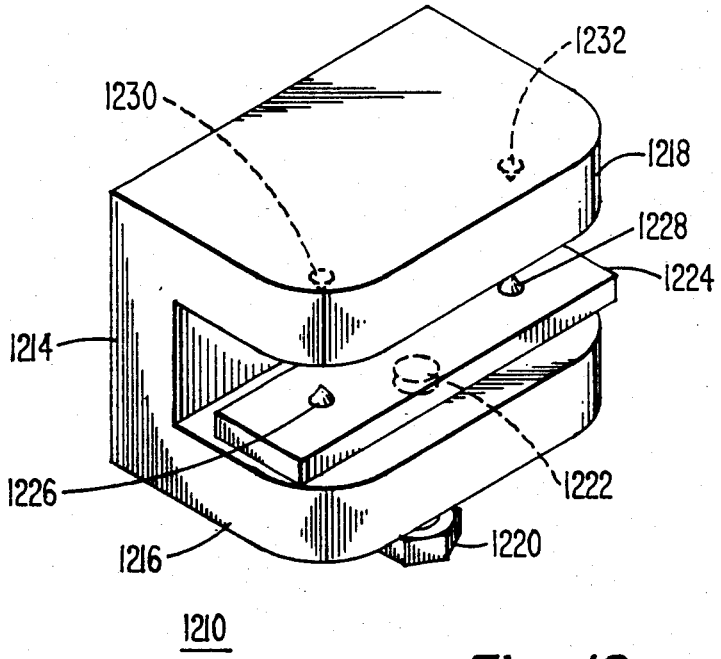
FIG. 12 is a perspective view of a clamp for applying force simultaneously to a number of points by means of a single adjustment.

FIG. 12 illustrates a clamp 1210 which may be used instead of clamp 50 of FIG. 1. In FIG. 12, a back 1214 supports a lower arm 1216 and an upper arm 1218. A screw or bolt 1220 is threaded through an aperture 1222 in lower arm 1216 and is captivated by means (not shown) to a pressure transfer plate 1224. Plate 1224 has a pair of protrusions 1226 and 1228, and upper arm 1218 has a pair of protrusions 1230 and 1232 at corresponding locations. The clamp is dimensioned so that when screw 1220 retracts plate 1224 against the inside of lower arm 1216, the clamp can be fitted over the coupler (not shown) with which it is to be used. Protrusions 1226, 1228, 1230, 1232 at this time overlie positions corresponding to 26 and 28 of FIG. 1, and corresponding positions on the other side of the coupler. When screw 1220 is tightened, pressure is distributed equally among the four projections 1226, 1228, 1230, 1232, causing simultaneous deflection of the upper and lower walls of the coupler and providing simultaneous height adjustment of the main waveguides thereof.

Figure 7:
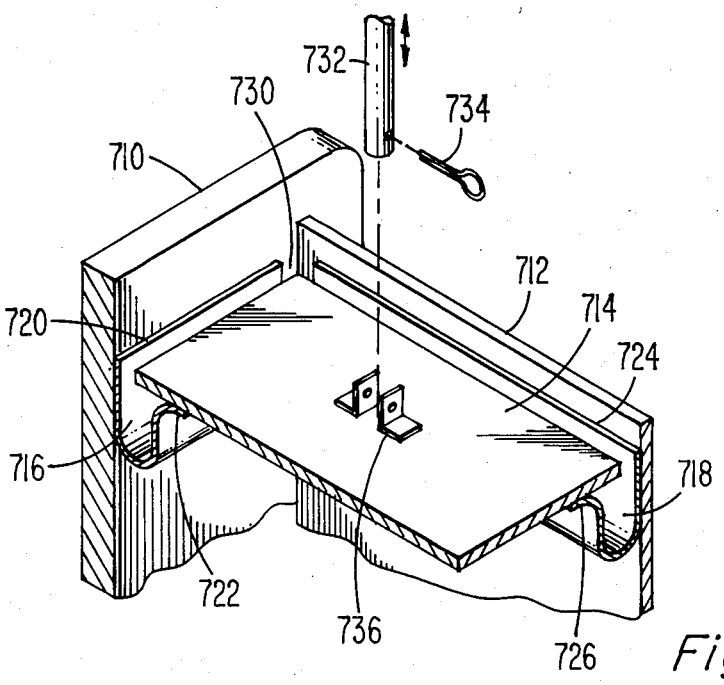
FIG. 7 illustrates an arrangement for adjusting the position of the wall of a waveguide suitable for use on large waveguides for low frequency use.

FIG. 7 illustrates in perspective view a portion of a flange 710, and sidewalls 712 and 714 of a large waveguide such as may be used at frequencies of 300 to 3000 MHz. Sidewall 712 is rigidly joined to flange 710 by soldering or brazing. Movable upper plate or wall 714 is held in place by bent beryllium-copper spring strips 716 and 718. The springs provide conductive contact between wall 714, flange 710 and wall 712. A top edge 720 of strip 716 is soldered to flange 710, and the other edge 722 of strip 716 is soldered along an edge of plate 714. Similarly, spring strip 718 is soldered along its upper edge 724 to rigid wall 712 and is also soldered along an edge 726 to upper plate 714. Thus, wall 714 is free to move up and down by a small amount, flexing the U-shaped strips 716, 718. It will be readly understood that upper wall 714 and a corresponding lower wall (not shown) are surrounded by flexible strips which allow the walls to move up and down by a small amount, causing a rolling flexure of conductive strips 716 and 718 and of the other strips (not shown) which may be required to complete the connections to the flanges and walls. Small openings occur in the region of each corner, such as corner 730, but these are small with respect to a wavelength and therefore do not cause significant radiation. The forces required to move wall 714 are applied by a longitudinally actuated perforated rod 732 and cotter-pin 734 coupled to a pair of brackets, illustrated together as 736, which are fastened to wall 714.

Figure 8:
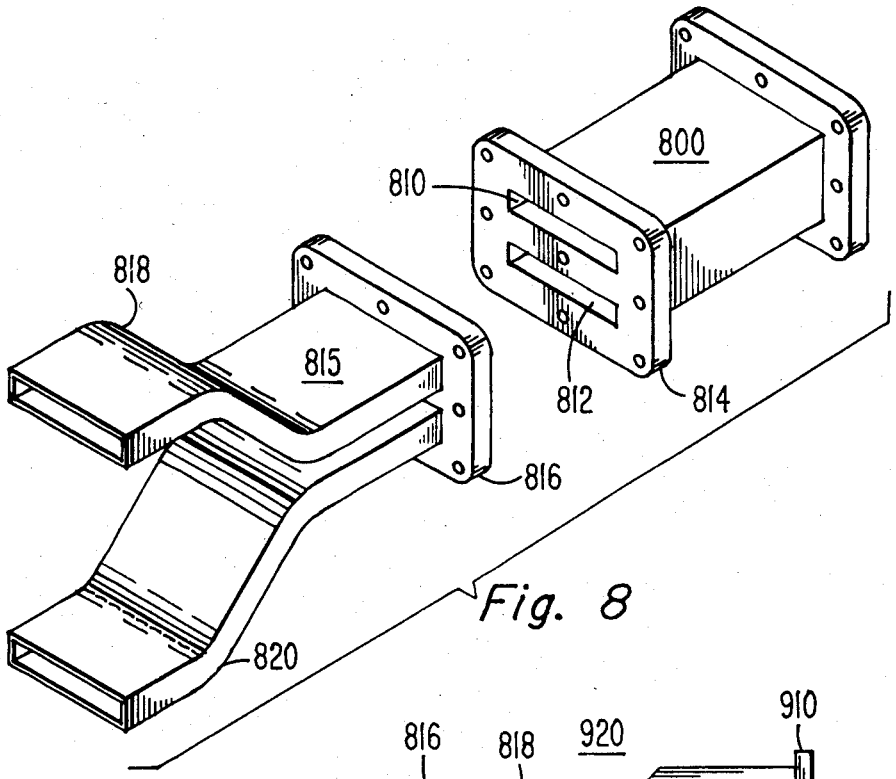
FIG. 8 is a perspective view of a waveguide directional coupler together with waveguides for coupling the parts to utilization apparatus.

Ordinarily, at least three of the ports of a waveguide directional coupler are coupled to a utilization appartus remote from the coupler. When half-height waveguide corresponding to half-height WR-75 waveguide having dimensions of 0.200×0.750 inch is used as the coupler main waveguide, ordinary WR-75 coupling flanges cannot be used to make waveguide connections. In order to use the coupler, waveguides must be coupled to the ports and arranged to diverge so as to be able to couple each of the three ports by its own waveguide to the utilizing or source apparatus. FIG. 8 illustrates in perspective view a general arrangement of this sort. In FIG. 8, a waveguide directional coupler designated generally as 800 includes ports 810 and 812 in a flange 814. A mating flange 816 is coupled to two half-height WR-75 waveguide sections 818 and 820 which, as can be seen, diverge so that individual flanges (not shown) may be attached to the remote ends of waveguides 818 and 820.

Figure 9:
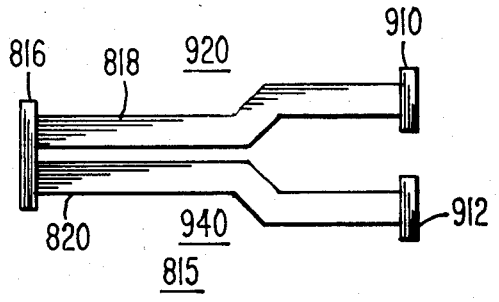
FIG. 9 is a side view of the waveguides of FIG. 8 showing a pair of bends.
Figure 10:
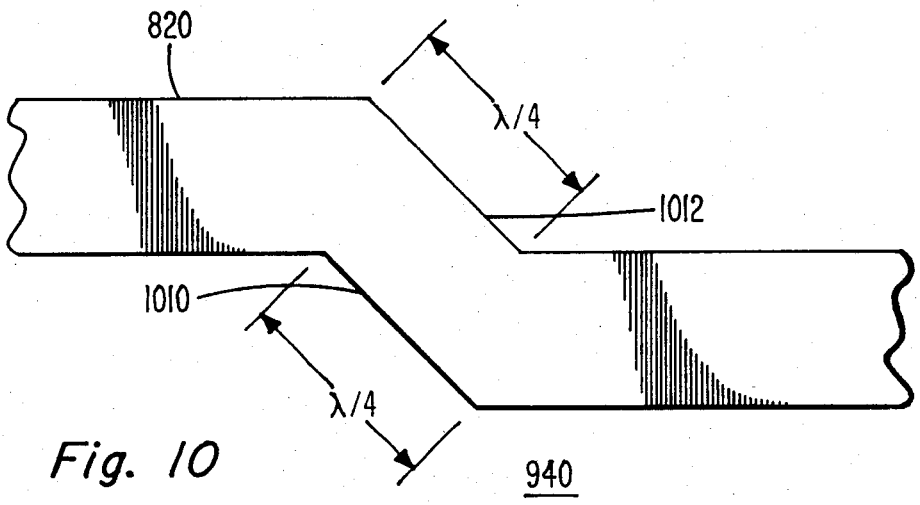
FIG. 10 illustrates a detail of the waveguides of FIG. 9.
Figure 11:
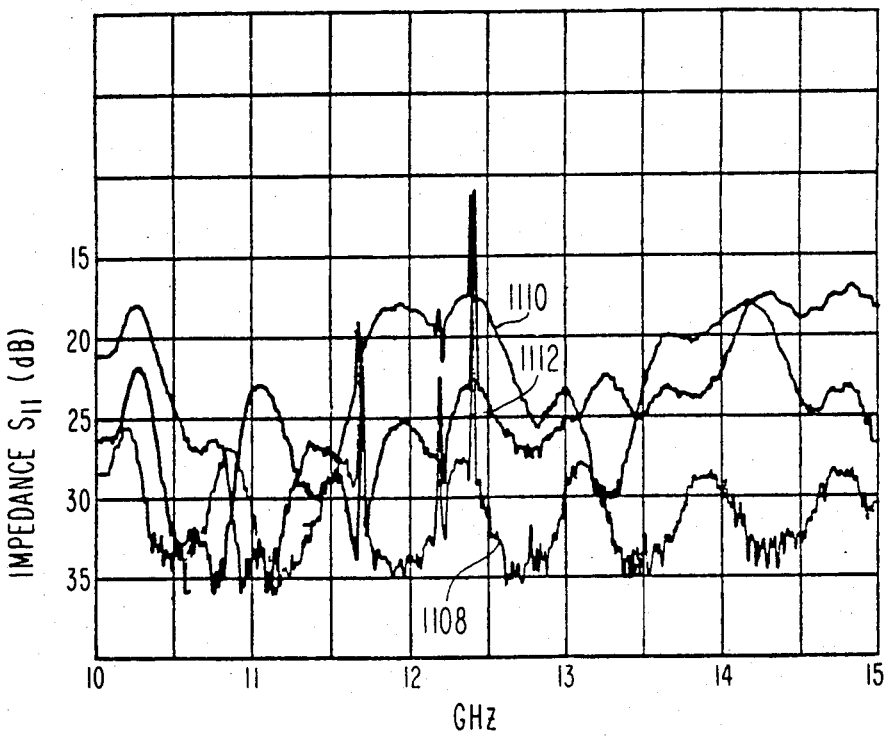
FIG. 11 is an impedance plot of terminated waveguides with and without bends.

FIG. 9 is a side view of a complete assembly 815 including flanges 816, 910 and 912, upper waveguide portion 818 and lower waveguide portion 820, and two pairs of mitred-corner bends designated generally as 920 and 940. Each of bends 920 and 940 includes a first bend portions 921, 941, respectively at a 45° angle and a second 45° bend portions 922, 942, respectively in the opposite direction, so that portion of waveguide 818 adjacent to flange 910 is parallel to that section adjacent to flange 816, and that portion of waveguide 820 adjacent flange 816 is parallel to that portion adjacent flange 912. FIG. 10 illustrates a detail of waveguide section 820 in the region of bend 940. As can be seen, the mitred-joint bend produces two sides 1010 and 1012 which have equal lengths. It has been found that the impedance discontinuity occasioned by the presence of the mitred joints is reduced if the two bends 941 and 942 are separated by one quarter-wavelength ($\lambda/4$). This condition occurs if sides 1010 and 1012 are each $\lambda/4$ long. The improvement in impedance can be seen in the impedance plot of FIG. 11. The ordinate in FIG. 11 represents impedance ($S_{11}$) in dB. The abscissa is frequency in GHz. Curve 1108 is the measured impedance of a terminator. Curve or plot 1110 shows a particular magnitude of impedance in the region of 12 to 12.5 GHz of a single waveguide bend and a termination. Curve 1112 shows an improvement by about 7 dB for a terminated waveguide with two such bends separated by $\lambda/4$.

Other embodiments of the invention will be obvious to those skilled in the art. In particular, directional couplers having waveguide heights other than 0.200 inches and having other cross-section ratios may be used. Where appropriate, the flanges illustrated, which are for the purpose of coupling the waveguide portions together, maybe dispensed with. Other means appropriate to changing the height of the main waveguides to achieve coupling changes may be used rather than the means shown. It may in some cases be appropriate to change the height of only one of the two main waveguides.

What is claimed:

1. An adjustable directional coupler, comprising:

first and second rectangular waveguide sections, each including a pair of conductive wide walls and means for spacing apart each of said wide walls of each said pair, and first and second rectangular waveguide sections being oriented parallel to each other;

a plurality of spaced branch waveguides extending from one of said wide walls of said first waveguide section to one of said wide walls of said second waveguide section for providing coupling between said first and second waveguides; and means for pressing the other of said wide walls in said first and second waveguide sections towards each other for mechanically controlling said spacing between said walls of each pair of wide walls to control said coupling between said first and second waveguides.

2. An adjustable waveguide branch coupler comprising:

a first waveguide including mutually parallel conductive first and second walls each having a predetermined width and spaced apart a first distance by a pair of conductive narrow walls, thereby defining a first cavity having a rectangular cross-section extending between first and second ports, said rectangular cross section having a larger dimension equal to said width and a smaller dimension equal to said first distance;

a second waveguide including mutually parallel conductive first and second walls each having said predetermined width and spaced apart a second distance by a pair of conductive narrow walls, thereby defining a second cavity having a rectangular cross-section extending between first and second ports, said rectangular cross section having a larger dimension equal to said width and a smaller dimension equal to said second distance;

a plurality of branch waveguides having equal lengths and extending from locations spaced along said first wall of said first waveguide to corresponding locations spaced along said first wall of said second waveguide thereby providing communication between said first and second cavities, the cross sectional dimensions of said branch waveguides and the spacing therebetween being selected to provide coupling from said first port of said first waveguide to said second port of said first waveguide and to said second port of said second waveguide while having substantially no coupling between said first port of said firt waveguide and said first port of said second waveguide; and adjustment means for applying pressure to said second walls of said first and second waveguides for adjusting the coupling between said ports, said adjustment means comprising means for effecting a deformation of at least said second walls of said first and second waveguides for simultaneously changing said first and second distance.

3. As adjustable directional coupler, comprising:

first and second rectangular waveguide sections each including a pair of wide walls and means for spacing apart each said pair of said wide walls, said first and second rectangular waveguide sections being oriented parallel to each other;

a plurality of spaced branch waveguides extending form one of said wide walls of said first waveguide section to one of said wide walls of said second waveguide section for providing coupling between said first and second waveguides;

means for pressing the other of said wide walls in said first and second waveguide sections towards each other for mechanically controlling said spacing between said walls of each pair of wide walls to control said coupling between said first and second waveguides;

and wherein said first and second waveguide sections extend parallel to each other away from said plurality of branch waveguides, and said first waveguide section further comprises a first bend at a predetermined angle to cause said first and second waveguide sections to diverge with increasing distance from said plurality of branch waveguides, and said first waveguide section further comprises a second bend at a location which is more remote from said plurality of branch waveguides than said first bend, said second bend having a second predetermined angle equal in magnitude to said first-mentioned predetermined angle; and said first and second bends are separated by one quarter-wavelength.

* * * * *